US008989632B2

(12) United States Patent
Leemhuis et al.

(10) Patent No.: US 8,989,632 B2
(45) Date of Patent: Mar. 24, 2015

(54) TONER ANTI-BRIDGING AGITATOR FOR AN IMAGE FORMING DEVICE

(75) Inventors: James Richard Leemhuis, Lexington, KY (US); Gregory Alan Cavill, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 132 days.

(21) Appl. No.: 13/564,037

(22) Filed: Aug. 1, 2012

(65) Prior Publication Data

US 2013/0266344 A1 Oct. 10, 2013

Related U.S. Application Data

(60) Provisional application No. 61/620,403, filed on Apr. 4, 2012.

(51) Int. Cl.
*G03G 15/08* (2006.01)

(52) U.S. Cl.
CPC ..... *G03G 15/0889* (2013.01)
USPC ..... 399/256

(58) Field of Classification Search
CPC ..... G03G 15/0839; G03G 15/0832; G03G 2215/085; G03G 2215/0827; G03G 15/0087; G03G 15/0887; G03G 15/0891; G03G 15/0865
USPC ..... 399/263, 358
See application file for complete search history.

(56) References Cited

U.S. PATENT DOCUMENTS

| | | | | |
|---|---|---|---|---|
| 2006/0018690 | A1 | 1/2006 | Blair et al. | |
| 2008/0080899 | A1* | 4/2008 | Mase | 399/254 |
| 2008/0095553 | A1* | 4/2008 | Tanaka et al. | 399/263 |
| 2008/0145105 | A1* | 6/2008 | Iwamura | 399/254 |
| 2008/0219706 | A1* | 9/2008 | Takayama | 399/222 |
| 2010/0143011 | A1* | 6/2010 | Tawada | 399/358 |

OTHER PUBLICATIONS

U.S. Appl. No. 13/611,104, filed Sep. 12, 2012.
Prosecution history of U.S. Appl. No. 13/611,104 including Non-Final Office Action dated Mar. 25, 2014.

* cited by examiner

*Primary Examiner* — David Gray
*Assistant Examiner* — Sevan A Aydin
(74) *Attorney, Agent, or Firm* — Justin M Tromp

(57) ABSTRACT

A removable unit for an electrophotographic image forming device according to one example embodiment includes a housing having an inner volume forming a toner reservoir and a channel for accumulating toner. An auger advances toner within the channel and has a rotational axis and a flight. An agitator is mounted on an inner surface of the housing and is positioned to extend toward the auger. The agitator has a first segment and a second distal segment connected to the first segment. When the auger rotates, the flight of the auger engages the agitator causing movement of the second distal segment to push toner accumulated in the channel into the auger.

17 Claims, 15 Drawing Sheets

TONER ANTI-BRIDGING AGITATOR FOR AN IMAGE FORMING DEVICE

CROSS REFERENCES TO RELATED APPLICATIONS

This application claims priority to U.S. Provisional Patent Application Ser. No. 61/620,403, filed Apr. 4, 2012, entitled "Toner Anti-Bridging Agitator for an Imaging Device," the content of which is hereby incorporated by reference in its entirety.

BACKGROUND

1. Field of the Disclosure

The present disclosure relates generally to electrophotographic image forming devices and more particularly to an anti-bridging agitator for an image forming device.

2. Description of the Related Art

In toner cartridge design, it is now common to separate components having a longer life from those having a shorter life into separate replaceable units. Relatively longer life components such as a developer roll, a toner adder roll, a doctor blade and a photoconductive drum are positioned in one replaceable unit (an "imaging unit"). The image forming device's toner supply, which is consumed relatively quickly in comparison with the components housed in the imaging unit, is provided in a reservoir in a separate replaceable unit in the form of a toner cartridge that mates with the imaging unit. In this configuration, the number of components housed in the toner cartridge is reduced in comparison with traditional toner cartridges.

To deliver toner from the toner cartridge to the imaging unit, an auger in the toner cartridge may be used to feed toner from an exit port on the toner cartridge into an entrance port on a developer unit of the imaging unit. The developer unit may include a second auger in proximity to the entrance port that disperses the toner within the developer unit. While the toner cartridge and the imaging unit are in high temperature storage or shipping conditions, toner stored therein may tend to clump together. When the toner cartridge and imaging unit are then installed in an image forming device, the clumped toner may form a bridge that disrupts or blocks toner flow from the toner cartridge to the imaging unit. Accordingly, a mechanism for keeping the pathway from the toner cartridge to the imaging unit free from packed toner is desired in order to improve toner delivery.

SUMMARY

A removable unit for an electrophotographic image forming device according to one example embodiment includes a housing having an inner volume forming a toner reservoir and a channel for accumulating toner. An auger advances toner within the channel and has a rotational axis and a flight. An agitator is mounted on an inner surface of the housing and is positioned to extend toward the auger. The agitator has a first segment and a second distal segment connected to the first segment. When the auger rotates, the flight of the auger engages the agitator causing movement of the second distal segment to push toner accumulated in the channel into the auger.

A toner conveyance assembly for an electrophotographic image forming device according to one example embodiment includes a channel for accumulating toner. An auger advances toner within the channel and has a rotational axis and a flight. An agitator is positioned to extend towards the auger. The agitator has a first segment and a second distal segment connected to the first segment. When the auger rotates, the flight of the auger engages the agitator causing movement of the second distal segment to push toner accumulated in the channel into the auger.

An agitator for a toner delivery device according to one example embodiment includes a base for mounting on an inner surface of a housing of the toner delivery device. A resiliently deflectable first segment is connected to the base. A second distal segment is connected to the first segment. The first segment and the second distal segment are positioned to extend toward an auger of the toner delivery device and engage a flight of the auger when the auger rotates causing movement of the second distal segment to push toner into the auger.

BRIEF DESCRIPTION OF THE DRAWINGS

The accompanying drawings incorporated in and forming a part of the specification, illustrate several aspects of the present disclosure, and together with the description serve to explain the principles of the present disclosure.

FIG. 17A shows an oscillating agitator positioned to engage an auger; FIGS. 17B and 17C show the agitator of FIG. 17A at different moments of operation.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
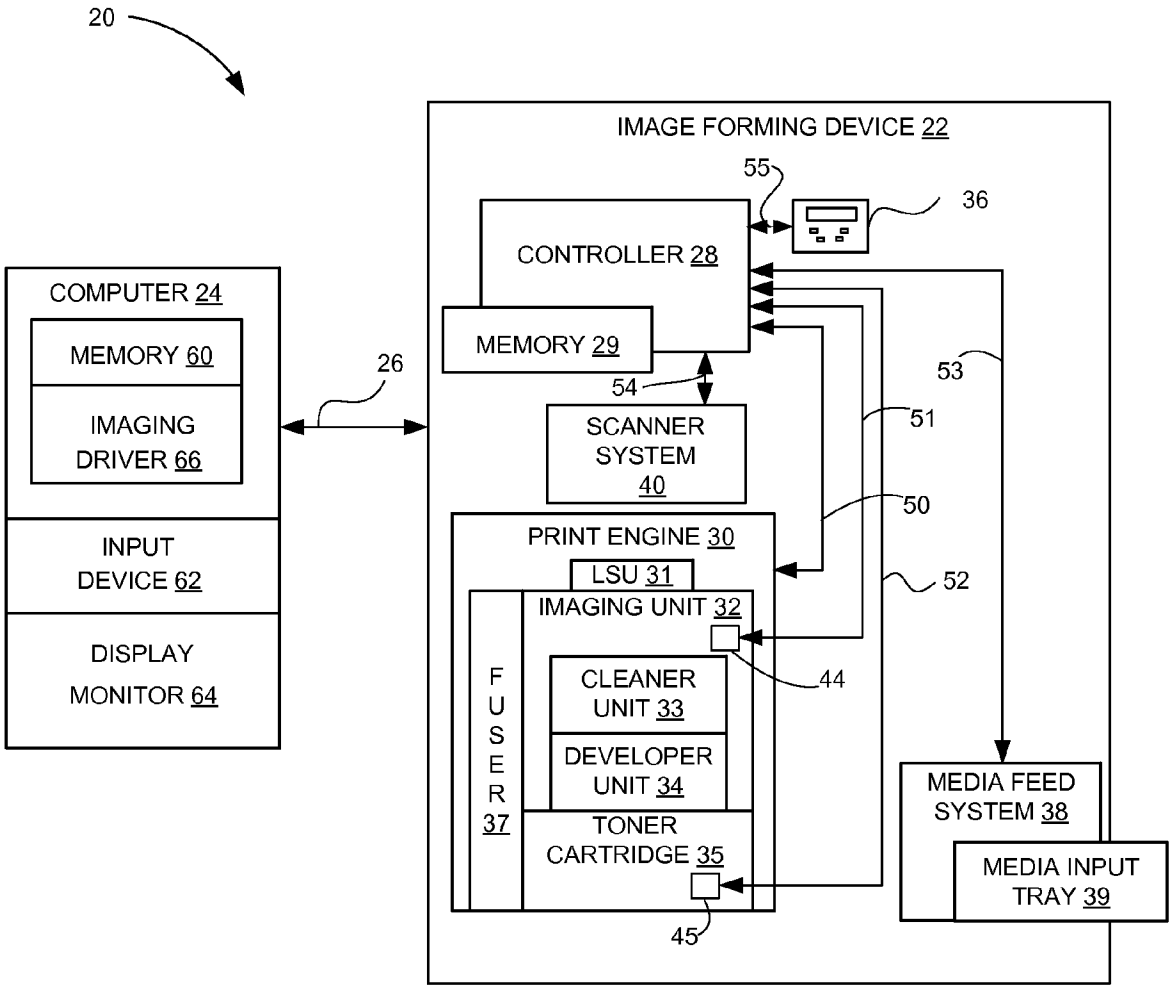
FIG. 1 is a block diagram of an imaging system according to one example embodiment.

Referring now to the drawings and more particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 32, a toner cartridge 35, a user interface 36, a media feed system 38 and media input tray 39 and a scanner system 40. Image forming device 22 may communicate with computer 24 via a standard communication protocol, such as for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated memory 29 and may be formed as one or more Application Specific Integrated Circuits (ASICs). Memory 29 may be any volatile or non-volatile memory or combination thereof such as, for example, random access memory (RAM), read only memory (ROM), flash memory and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

the example embodiment illustrated, controller 28 communicates with print engine 30 via a communications link 50. Controller 28 communicates with imaging unit 32 and processing circuitry 44 thereon via a communications 51. Controller 28 communicates with toner cartridge 35 and processing circuitry 45 therein via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuitry 44, 45 may provide authentication functions, safety and operational interlocks, operating parameters and usage information related to imaging unit 32 and toner cartridge 35, respectively. Controller 28 processes print and scan data and operates print engine 30 during printing and scanner system 40 during scanning.

Computer 24, which is optional, may be, for example, a personal computer, including memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate the collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes laser scan unit (LSU) 31, toner cartridge 35, imaging unit 32, and a fuser 37, all mounted within image forming device 22. Imaging unit 32 is removably mounted in image forming device 22 and includes a developer unit 34 that houses a toner reservoir (or toner sump) and a toner delivery system. The toner delivery system includes a toner adder roll that provides toner from the toner sump to a developer roll. A doctor blade provides a metered uniform layer of toner on the surface of the developer roll. Imaging unit 32 also includes a cleaner unit 33 that houses a photoconductive drum and a waste toner removal system. Toner cartridge 35 is also removably mounted in imaging unit 32 in a mating relationship with developer unit 34 of imaging unit 32. An exit port on toner cartridge 35 communicates with an entrance port on developer unit 34 allowing toner to be periodically transferred from a reservoir in toner cartridge 35 to resupply the toner sump in developer unit 34.

The electrophotographic printing process is well known in the art and, therefore, is described briefly herein. During a printing operation, laser scan unit 31 creates a latent image on the photoconductive drum in cleaner unit 33. Toner is transferred from the toner sump in developer unit 34 to the latent image on the photoconductive drum by the developer roll to create a toned image. The toned image is then transferred to a media sheet received in imaging unit 32 from media input tray 39 for printing. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
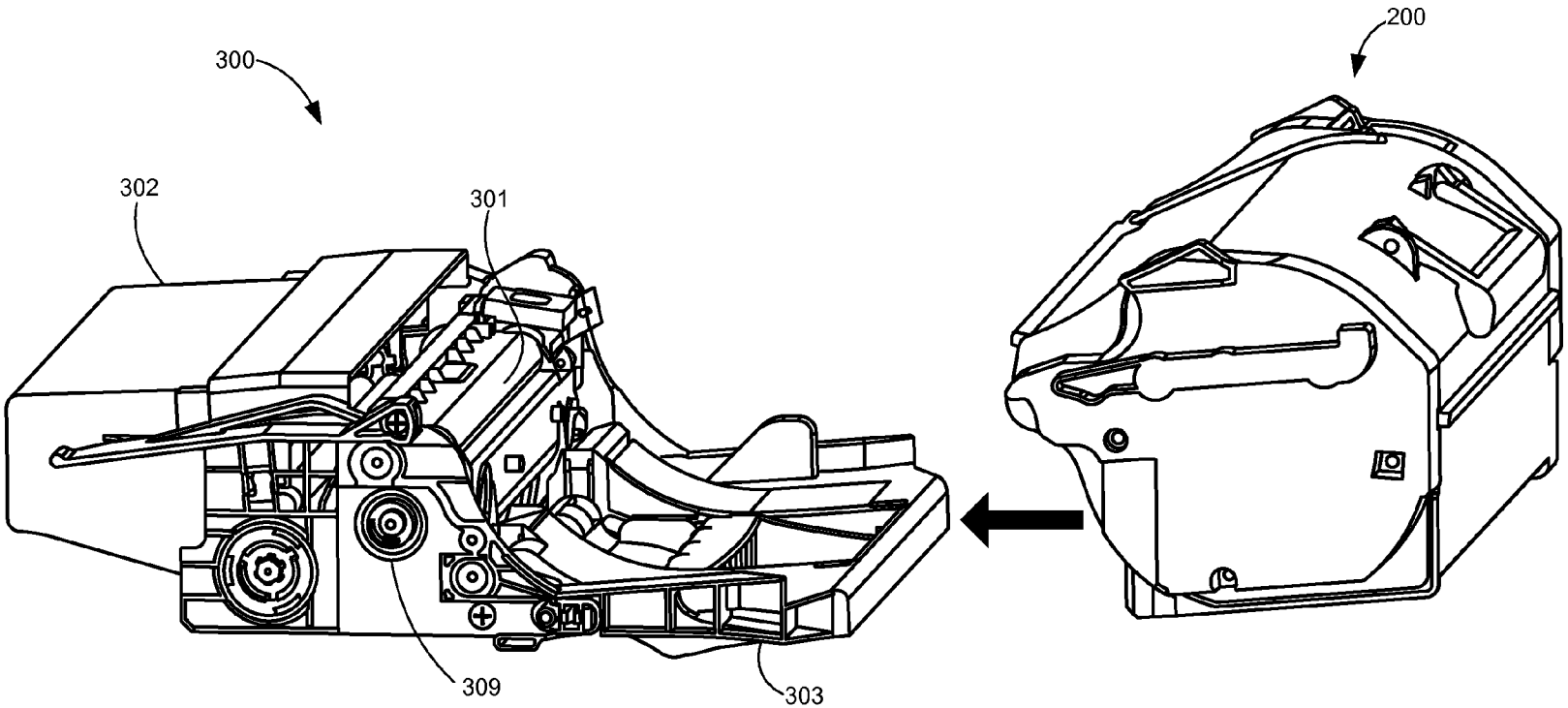
FIG. 2 is a perspective view of a toner cartridge and an imaging unit of FIG. 1 according to one example embodiment.

Referring now to FIG. 2, a toner cartridge 200 and an imaging unit 300 are shown according to one example embodiment. Imaging unit 300 includes a developer unit 301 and a cleaner unit 302 mounted on a common frame 303. As discussed above, imaging unit 300 and toner cartridge 200 are each removably installed in image forming device 22. Imaging unit 300 is first slidably inserted into image forming device 22. Toner cartridge 200 is then inserted into image forming device 22 and onto frame 303 in a mating relationship with developer unit 301 of imaging unit 300 as indicated by the arrow shown in FIG. 2. This arrangement allows toner cartridge 200 to be removed and reinserted easily when replacing an empty toner cartridge without having to remove imaging unit 300. Imaging unit 300 may also be readily removed as desired in order to maintain, repair or replace the components associated with developer unit 301, cleaner unit 302 or frame 303 or to clear a media jam.

Figure 3:
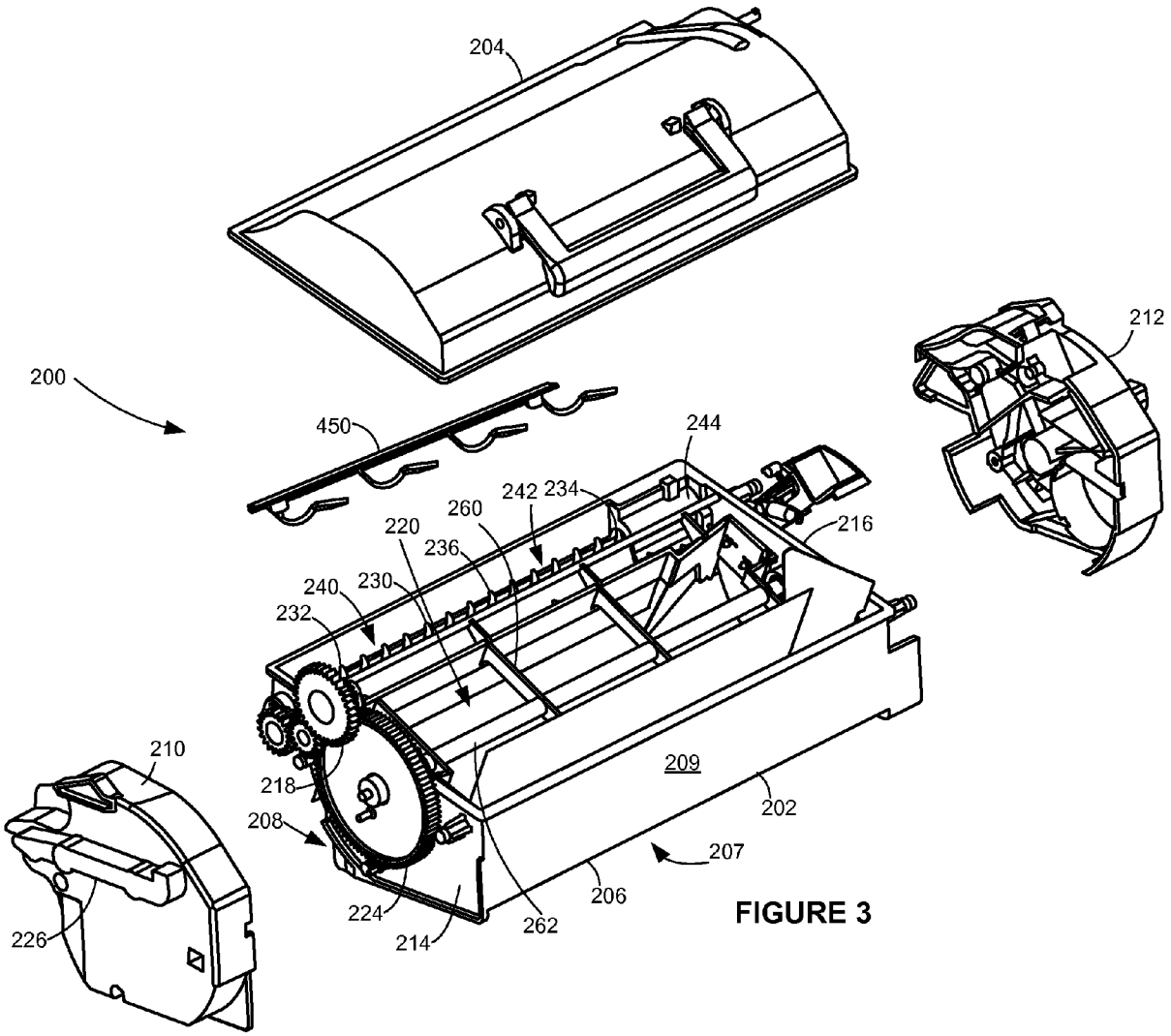
FIG. 3 is an exploded view of the toner cartridge shown in FIG. 2.

Referring now to FIG. 3, toner cartridge 200 includes a housing 202 having an enclosed reservoir 220 for holding a quantity of toner therein. Housing 202 may be viewed as having a top or lid 204 mounted on a base 206. Base 206 is formed by first and second side walls 214, 216 connected to adjoining front and rear walls 208, 209 and bottom 207. In one embodiment, top 204 is ultrasonically welded to base 206 thereby forming enclosed reservoir 220. First and second end caps 210, 212 are mounted to side walls 214, 216, respectively. First and second end caps 210, 212 may be snap fitted into place or attached by screws or other fasteners. First and second end caps 210, 212 each include guides 226 to assist the insertion of toner cartridge 200 into image forming device 22 for mating with developer unit 301. Various gears are housed within a space formed between first end cap 210 and first side wall 214. At least a portion of a main interface gear 218 is exposed between first end cap 210 and first side wall 214 at the front of toner cartridge 200 to allow main interface gear 218 to engage with a drive system in imaging apparatus 22 that provides torque to main interface gear 218. As a result, first side wall 214 may be referred to as the "drive" or "driven" side of toner cartridge 200. Various interlocks and/or linkages may be housed within the space formed between second end cap 212 and second side wall 216. A paddle 260 is rotatably mounted within toner reservoir 220. First and second ends of a drive shaft 262 of paddle 260 extend through aligned openings (not shown) in first and second side walls 214, 216, respectively. A drive gear 224 is provided on the first end of drive shaft 262 that engages with main interface gear 218 either directly or via one or more intermediate gears.

A channel 240 extends along the width of front wall 208 between first and second side walls 214, 216. In one embodiment, channel 240 is positioned above the axis of rotation of drive shaft 262 of paddle 260. Channel 240 may be integrally molded as part of front wall 208 or be formed as a separate component attached to front wall 208. Channel 240 is generally horizontal when toner cartridge 200 is installed in image forming device 22. An auger 230 having first and second ends 232, 234, and a spiral screw flight 236 is positioned within and extends along the length of channel 240. First end 232 of auger 230 extends through a bushing 238 (FIG. 6) in first side wall 214. A drive gear (not shown) is positioned on first end 232 of auger 230 that engages with main interface gear 218 either directly or via one or more intermediate gears.

Figure 4:
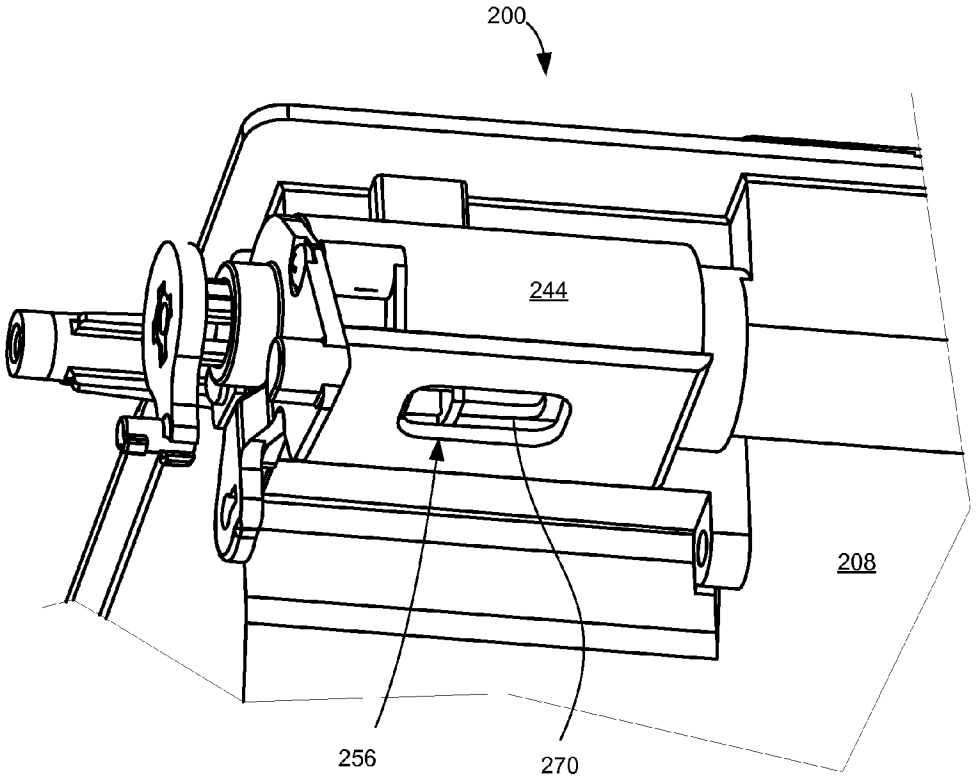
FIG. 4 is a perspective view of a toner exit port of the toner cartridge shown in FIG. 2.

Channel 240 includes an open portion or trough 242 and a substantially enclosed portion 244. Trough 242 is open to toner reservoir 220 and extends from first side wall 214 toward second side wall 216. Enclosed portion 244 of channel 240 extends from second side wall 216 and encloses second end 234 of auger 230. As paddle 260 rotates, it delivers toner from toner reservoir 220 into trough 242. With reference to FIGS. 3 and 4, auger 230 is rotated via the drive gear on first end 232 of auger 230 to deliver toner received in channel 240 to a shutter 270 housed in enclosed portion 244 of channel 240. Shutter 270 regulates whether toner is permitted to exit toner cartridge 200 through an exit port 256 provided in front wall 208 and shown in FIG. 4. Exit port 256 is disposed at the bottom of channel 240 so that gravity will assist in exiting toner through exit port 256.

Figure 5:
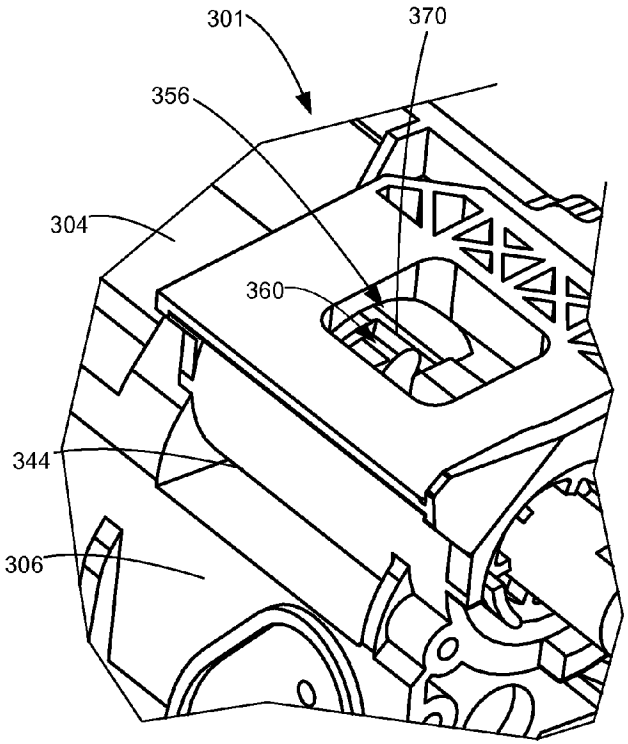
FIG. 5 is a perspective view of a toner entrance port of a developer unit of the imaging unit shown in FIG. 2.
Figure 6:
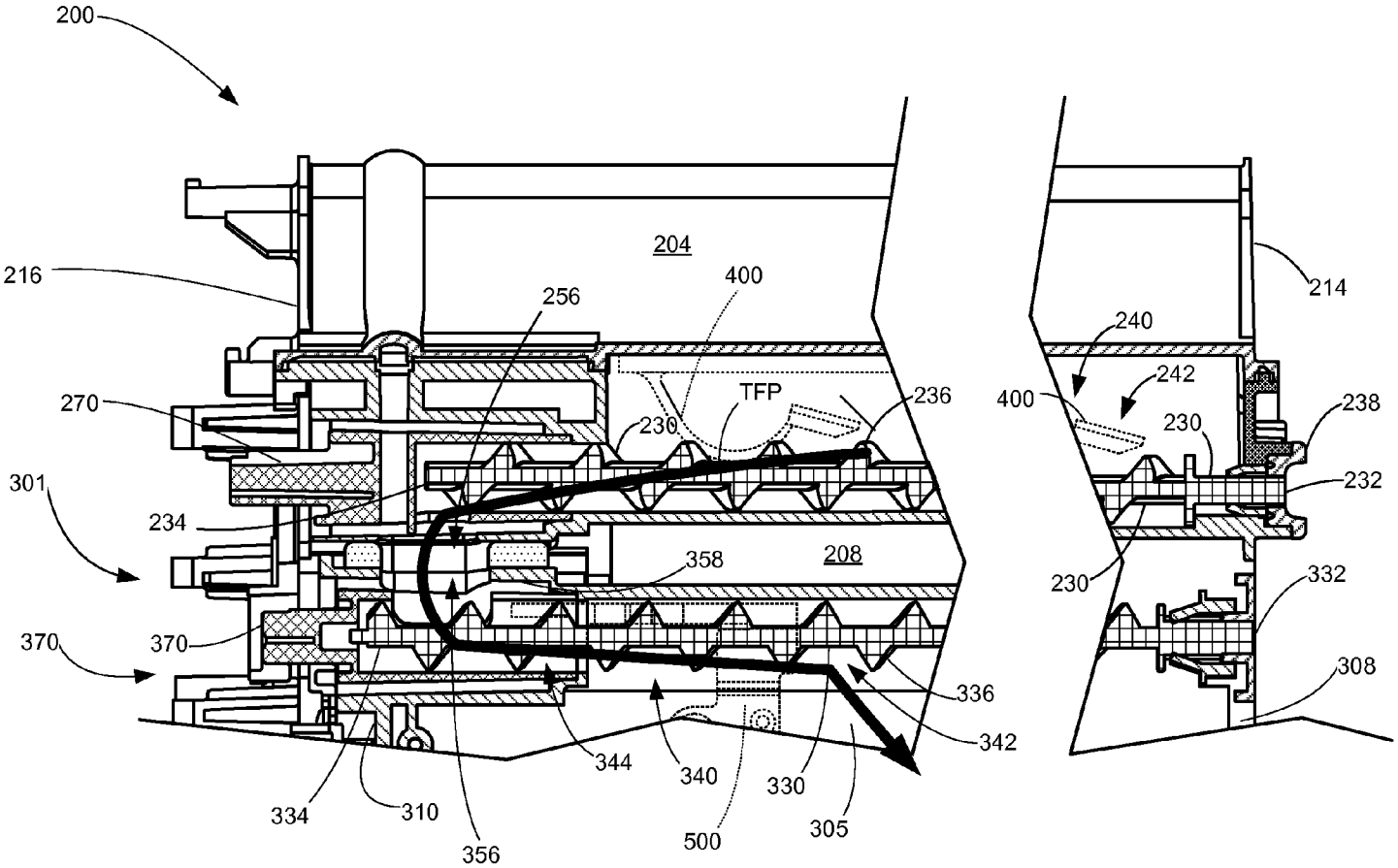
FIG. 6 is a cutaway view of the exit port of the toner cartridge of FIG. 4 in communication with the entrance port of the developer unit of FIG. 5.

With reference to FIGS. 5 and 6, developer unit 301 includes a housing 304 having a toner sump 305 formed by a rear wall 306, first and second side walls 308, 310 and a bottom (not shown). A channel 340 extends along the width of and near the top of rear wall 306. Channel 340 may be integrally molded as part of rear wall 306 or be formed as a separate component attached to rear wall 306. An auger 330 having first and second ends 332, 334, and a spiral screw flight 336 is positioned within and extends along the length of channel 340. First end 332 of auger 330 extends through first side wall 308. A drive gear (not shown) is positioned on first end 332 of auger 330 that engages with an input coupler 309 (FIG. 2) of developer unit 301 either directly or via one or more intermediate gears. Input coupler 309 receives torque at its axial end from a drive system in image forming device 22 to drive various rotatable components in developer unit 301 including auger 330.

Channel 340 includes an open portion or trough 342 and a substantially enclosed portion 344. Trough 342 is open to toner sump 305 and extends from first side wall 308 toward second side wall 310. Enclosed portion 344 of channel 340 extends from second side wall 310 and encloses second end 334 of auger 330. An entrance port 356 is provided through a wall 358 of enclosed portion 344 of channel 340. Entrance port 356 of developer unit 301 aligns with exit port 256 of toner cartridge 200 when toner cartridge 200 is installed on frame 303 and mated with imaging unit 300. As illustrated in FIG. 5, entrance port 356 is disposed at the top of channel 340 so that gravity will assist toner entry into developer unit 301. In one example form, entrance port 356 is larger in area than exit port 256 to prevent bridging by the toner exiting toner cartridge 200 and entering developer unit 301.

A shutter 370 positioned in enclosed portion 344 of channel 340 regulates whether toner is permitted to enter developer unit 301 through entrance port 356. Second end 334 of auger 330 extends into shutter 370 allowing auger 330 to distribute the incoming toner along channel 340. Trough 342 includes a plurality of openings (not shown) spaced along its length. The openings extend through a bottom portion of trough 342. Auger 330 is rotated via the drive gear on first end 332 of auger 330 to distribute toner received from exit port 256 of toner cartridge 200 along the length of trough 342. The openings in trough 342 allow incoming toner to be distributed substantially evenly into toner sump 305. Channel 340 is disposed above toner sump 305 allowing the entering toner to drop into toner sump 305.

FIG. 6 illustrates the toner flow path (shown as the solid arrow labeled "TFP") between toner cartridge 200 and developer unit 301. In operation, toner is first passed from reservoir 220 to channel 240 by paddle 260. Auger 230 then advances the toner through shutter 270 and out exit port 256. The toner falls via gravity from exit port 256 into entrance port 356 of developer unit 301. The toner is passed through shutter 370 and distributed along channel 340 by auger 330. The toner then drops through the openings in trough 342 into toner sump 305 where it is held for use by developer unit 301, Shutters 270, 370 of toner cartridge 200 and developer unit 301 are moved from closed positions to open positions as toner cartridge 200 is mated with imaging unit 300 to allow toner to flow from toner cartridge 200 to developer unit 301. Shutters 270, 370 are moved from open positions to closed positions as toner cartridge 200 is separated from imaging unit 300 in order to prevent toner leakage from toner cartridge 200 or developer unit 301.

Figure 7:
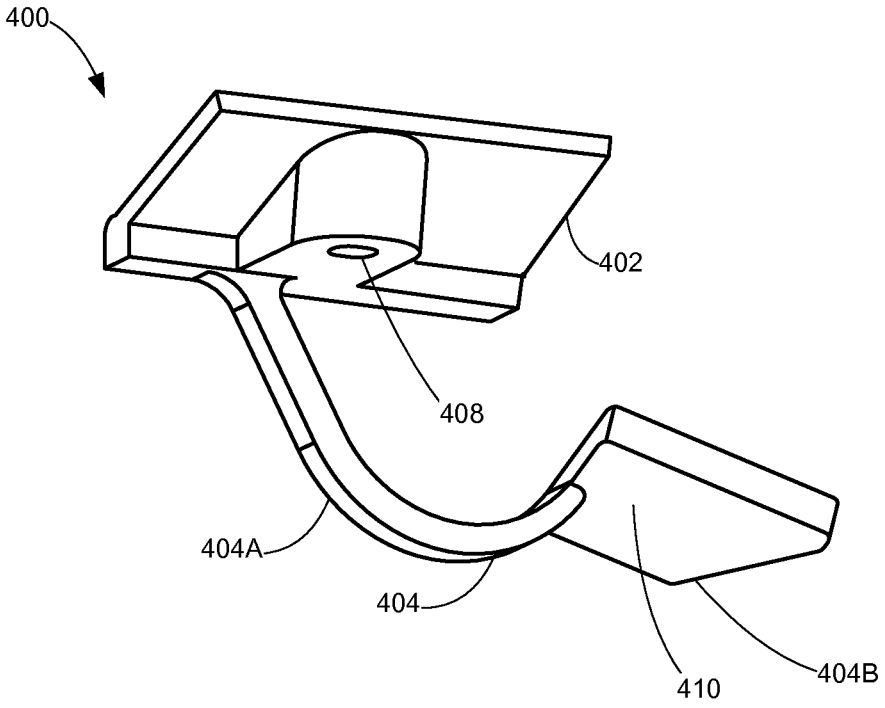
FIG. 7 is a perspective view of an agitator according to one example embodiment.

As discussed above, toner under high temperature storage or shipping conditions may tend to clump or bridge in channels 240, 340 above augers 230, 330. In some instances, the clumped or bridged toner may block additional toner from being transported through channel 240 or channel 340 potentially causing toner starvation. To address this potential problem, an agitator is provided in channel 240 of toner cartridge 200 and/or channel 340 of developer unit 301 to break up any clumped toner. FIGS. 6 and 7 show one example agitator 400. Agitator 400 includes a base 402 that mounts to an inner surface of housing 202 above channel 240 as shown in FIG. 6. Agitator 400 may also be provided in developer unit 301 as desired by mounting base 402 to an inner surface of housing 304 above channel 340. A resiliently deflectable member 404 extends in a cantilevered manner from base 402. Deflectable member 404 includes a first segment 404A that connects to base 402 and a second segment 404B connected to the distal end of first segment 404A. In one embodiment, first segment 404A extends from base 402 in the form of a resiliently deflectable arm and second segment 404B forms a tab or paddle on the end of first segment 404A. In this embodiment, second segment 404B has a substantially planar undersurface 410 for pushing toner toward auger 230 as discussed below. In the example embodiment shown in FIG. 7, agitator 400 attaches to housing 202 or housing 304 via a fastener (not shown) mounted through a fastener hole 408 in base 402; however, agitator 400 may be mounted by any suitable method such as, for example by an adhesive applied between base 402 and housing 202 or housing 304.

Figure 8A:
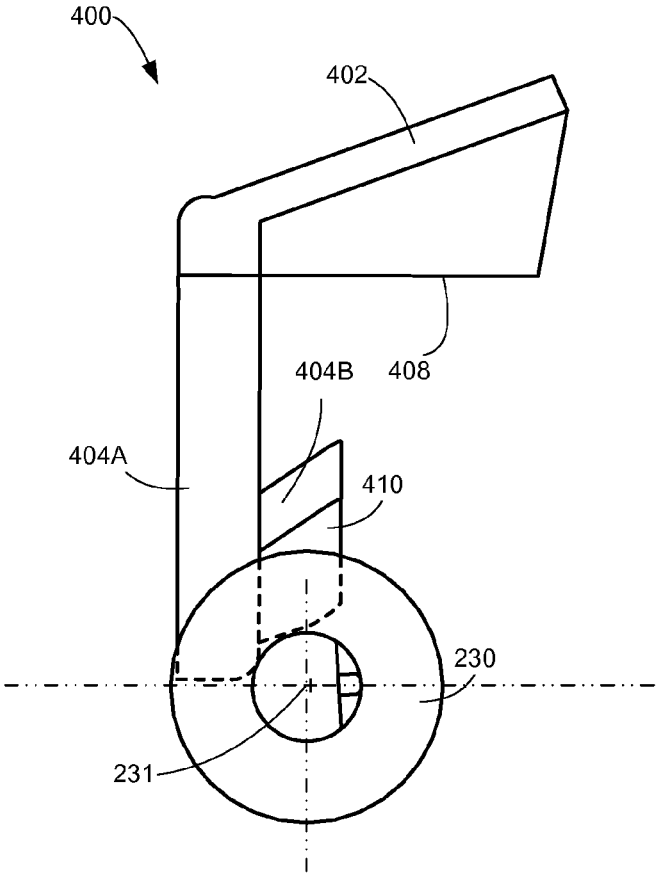
FIGS. 8A and 8B are a side view and a front view, respectively, of the agitator shown in FIG. 7 positioned to engage an auger of the toner cartridge.
Figure 8B:
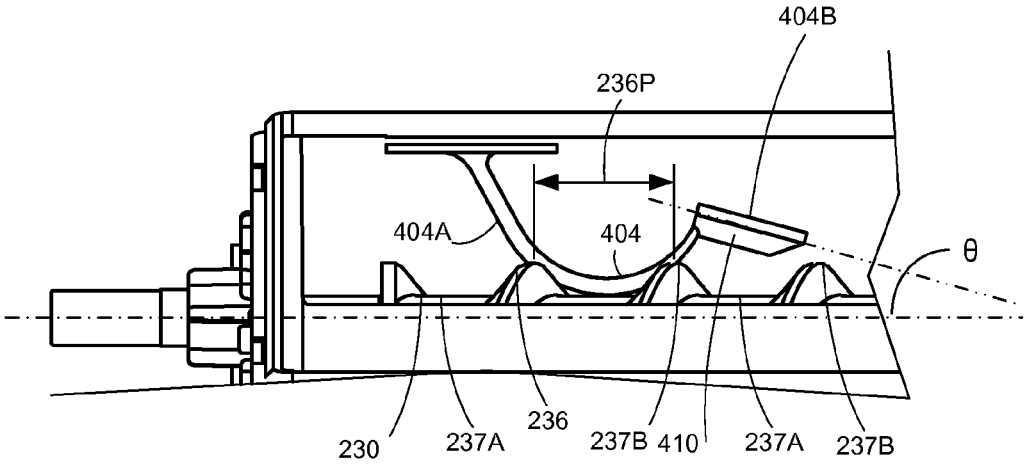

FIGS. 8A and 8B show a side view and a front view, respectively, of agitator 400 mounted relative to auger 230. As illustrated in FIG. 8A, in the example embodiment illustrated, first segment 404A extends from base 402 in a substantially vertical direction relative to cartridge 200 and is laterally offset from the rotational axis 231 of auger 230. As shown in FIG. 8B, first segment 404A has an arcuate profile that engages flight 236 of auger 230 like a cam. The arcuate profile of first segment 404A has a radius that is sized to span a pitch 236P of flight 236 of auger 230. The arcuate profile allows first segment 404A to maintain contact with auger 230 as auger 230 rotates preventing agitator 400 from floating and vibrating thereby reducing the likelihood of undesired noise. Second segment 404B extends away from first segment 404A along a plane that is transverse to the rotational axis 231 of auger 230 such that second segment 404B forms an acute angle Θ with respect to the rotational axis 231 of auger 230 when agitator 400 is in its free state. This enables agitator 400 to have a larger working area for disturbing clumped toner. In one example embodiment, undersurface 410 forms an angle Θ of about 45 degrees with respect to the rotational axis 231 of the auger 230 when agitator 400 is in its free state.

Agitator 400 extends into the rotational path of auger 230 such that deflectable member 404 oscillates up and down as auger 230 rotates in order to break up any clumped or bridged toner in channel 240. Specifically, as auger 230 rotates, first segment 404A of deflectable member 404 rides up and down the roots 237A and crests 237B of flight 236. When first segment 404A contacts a crest 237B, first segment 404A temporarily deflects causing second segment 404B to travel away from auger 230. As auger 230 rotates further and first segment 404A returns to a root 237A, second segment 404B travels back toward auger 230. The oscillating movement of agitator 400 allows second segment 404B to serve as a paddle to push toner accumulating above channel 240 toward auger 230 so that the toner may be moved by auger 230.

Figure 9:
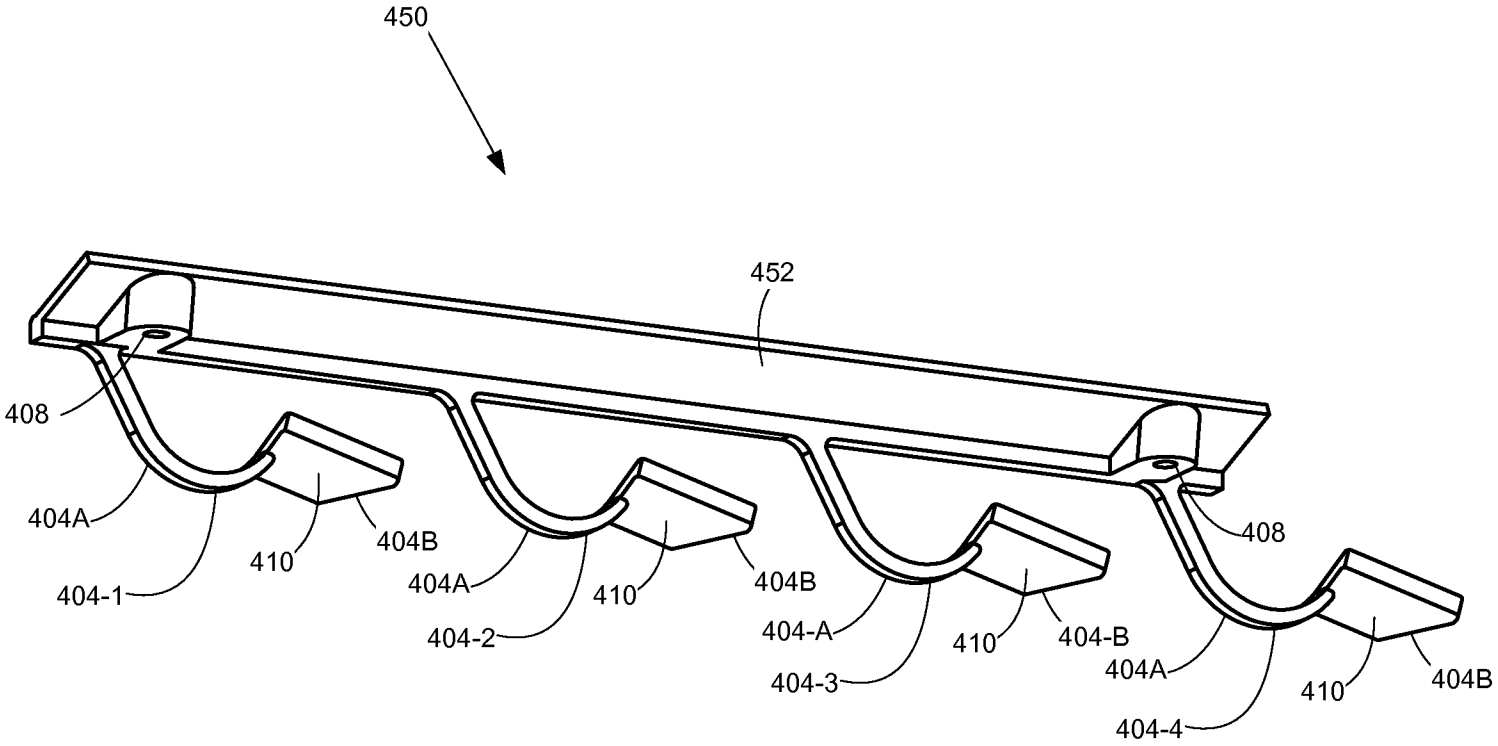
FIG. 9 is a perspective view of an agitator according to a second example embodiment.
Figure 10A:
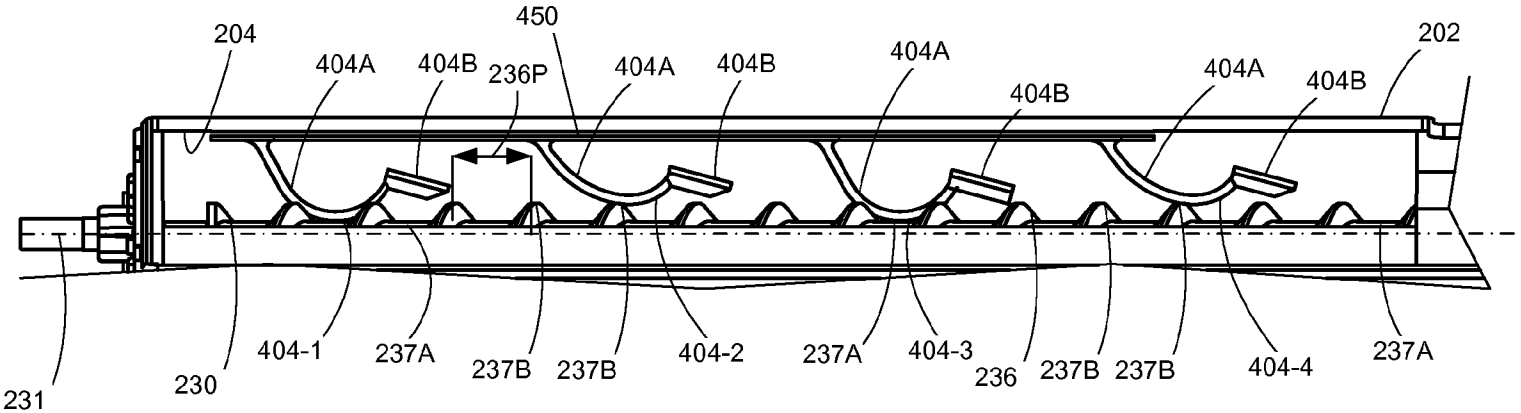
FIGS. 10A and 10B are sectional front views of a portion of the toner cartridge of FIG. 2 showing the agitator of FIG. 9 at different moments of operation.
Figure 10B:
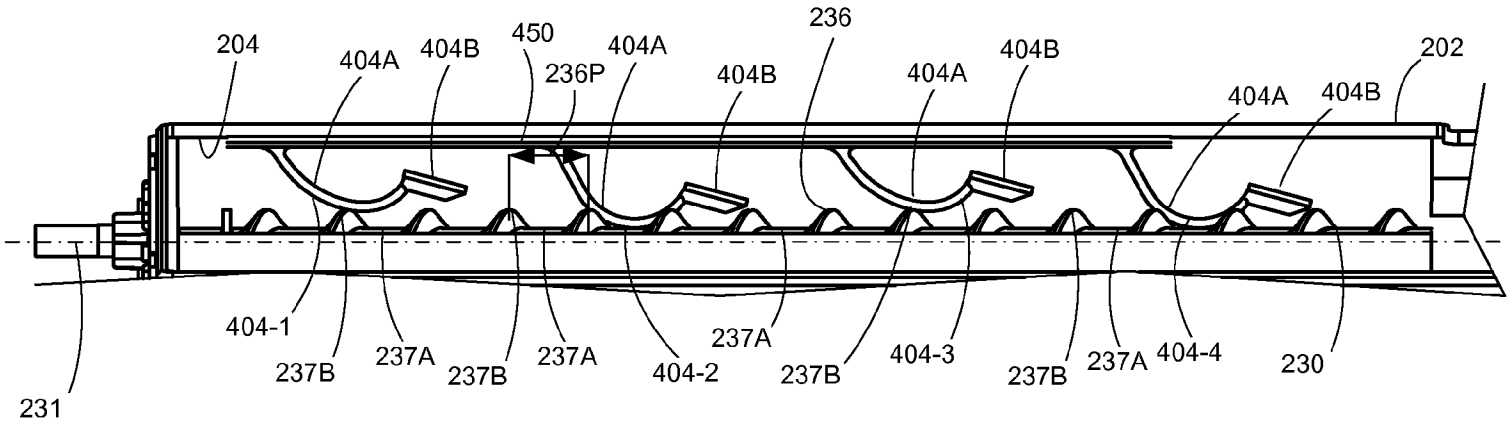

FIG. 9 shows another example embodiment of an agitator 450 that includes a plurality of resiliently deflectable members 404-1, 404-2, 404-3, 404-4, each having a form similar to deflectable member 404 of agitator 400 and formed unitarily with an elongated base 452. It is understood that agitator 450 may include any number of deflectable members as desired. With reference to FIGS. 10A and 10B, agitator 450 is shown mounted on an inner surface of housing 202 such as an inner surface of top 204. Of course agitator 450 may also be mounted to housing 304 of developer unit 301 as desired. Agitator 450 is positioned to generally extend toward auger 230 such that a longitudinal axis of agitator 450 is substantially parallel to the rotational axis 231 of auger 230. Like agitator 400 discussed above, each of the first segments 404A of resiliently deflectable members 404-1, 404-2, 404-3, 404-4 extends from elongated base 452 in a cantilevered manner and has an arcuate profile sized to span a pitch 236P of flight 236 of auger 230. As a result, each of the first segments 404A is positioned to maintain contact with auger 230 as auger 230 rotates. Further, in order to maintain a more constant torque on auger 230, resiliently deflectable members 404-1, 404-2, 404-3, 404-4 are preferably spaced apart from each other and arranged such that adjacent members 404-1, 404-2, 404-3, 404-4 are not lifted at the same time. For example, as shown in FIG. 10A, when first segments 404A of resiliently deflectable members 404-2 and 404-4 engage a crest 237B of auger 230, the immediately adjacent resiliently deflectable members 404-1 and 404-3 engage a root 237A of auger 230. As auger 230 rotates to a second position shown in FIG. 10B, resiliently deflectable members 404-1 and 404-3 engage a crest 237B and resiliently deflectable members 404-2 and 404-4 engage a root 237A. Torque variation is preferably minimized in order to reduce the load on a motor in image forming device 22 that drives auger 230. If resiliently deflectable members 404-1, 404-2, 404-3, 404-4 were positioned to rise and fall at the same time, the torque on auger 230 would be higher when resiliently deflectable members 404-1, 404-2, 404-3, 404-4 raised and lower when resiliently deflectable members 404-1, 404-2, 404-3, 404-4 fell.

Figure 11:
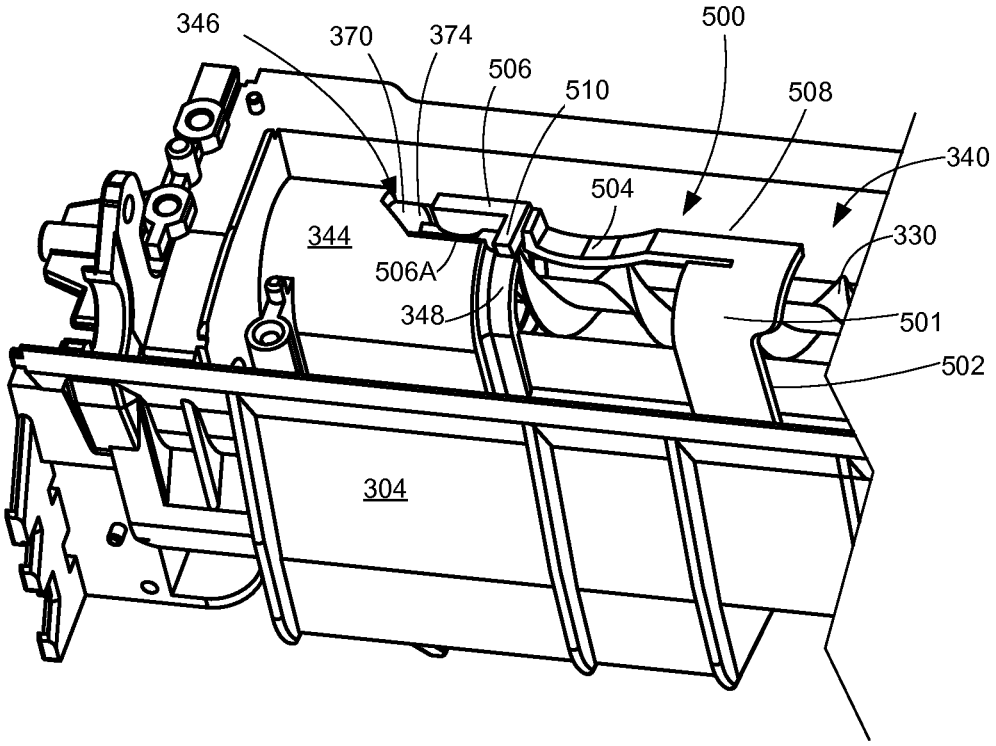
FIG. 11 is a perspective view of a portion of the developer unit of FIG. 2 showing an agitator according to another example embodiment.
Figure 12:
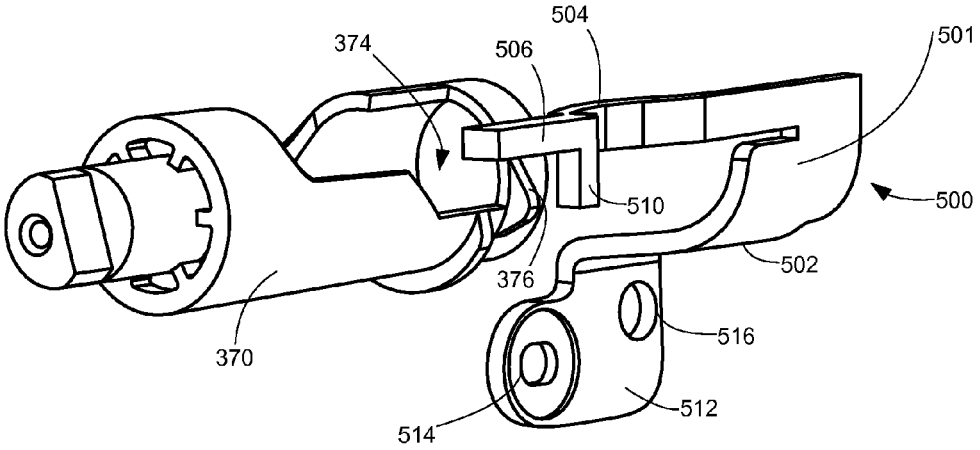
FIG. 12 is a top perspective view of the agitator of FIG. 11 engaging a cam surface of a shutter.

FIGS. 11-13B show an agitator 500 according to another example embodiment for use in developer unit 301. As shown in FIG. 11, agitator 500 is positioned to extend through an aperture 346 in enclosed portion 344 of channel 340 and into an aperture 374 in shutter 370 to agitate toner in an area that otherwise may be particularly susceptible to clogging. With reference to FIG. 12, agitator 500 includes a base 512 and a resiliently deflectable member 501 that extends from base 512. In the example embodiment illustrated, base 512 attaches to housing 304 by a fastener (not shown) mounted through a fastener hole 514; however, it will be appreciated that base 512 may be attached by any suitable method. In this embodiment, base 512 further includes a locating hole 516 that receives a corresponding peg on housing 304 to ensure that base 512 is located accurately relative to housing 304. Of course this configuration may be reversed as desired such that base 512 includes a locating peg and housing 304 includes a corresponding hole or recess. Resiliently deflectable member 501 includes a connecting segment 502 that extends from base 512 in a cantilevered manner. As shown in FIG. 11, connecting segment 502 curves around the front of channel 340 to a position above auger 330. An arm segment 504 extends from connecting segment 502 above auger 330 toward shutter 370. Arm segment 504 includes an arcuate profile that is sized and shaped to engage the flight 336 of auger 330 like first segment 404A discussed above. A distal segment 506 extends from arm segment 504 above apertures 346 and 374. In the example embodiment illustrated, distal segment 506 includes a protuberance 506A that projects toward apertures 346 and 374 to push toner toward auger 330.

Figure 13A:
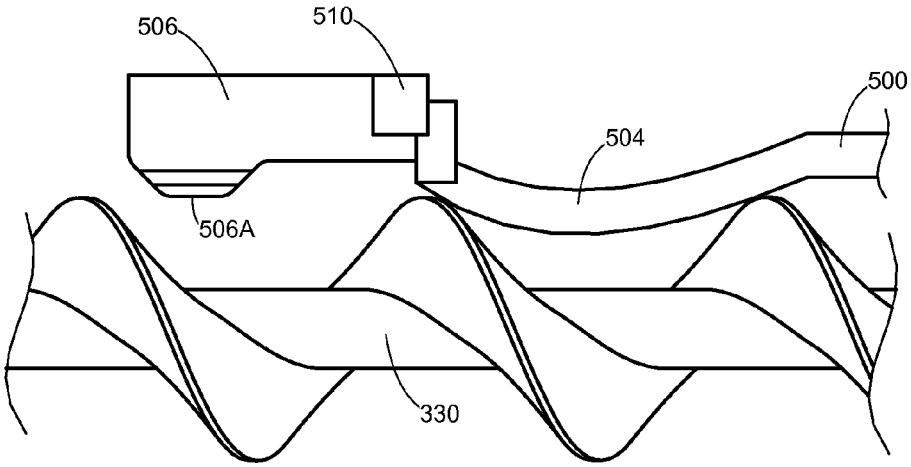
FIGS. 13A and 13B are front views showing the agitator of FIG. 11 engaging an auger of the developer unit at different moments of operation.
Figure 13B:
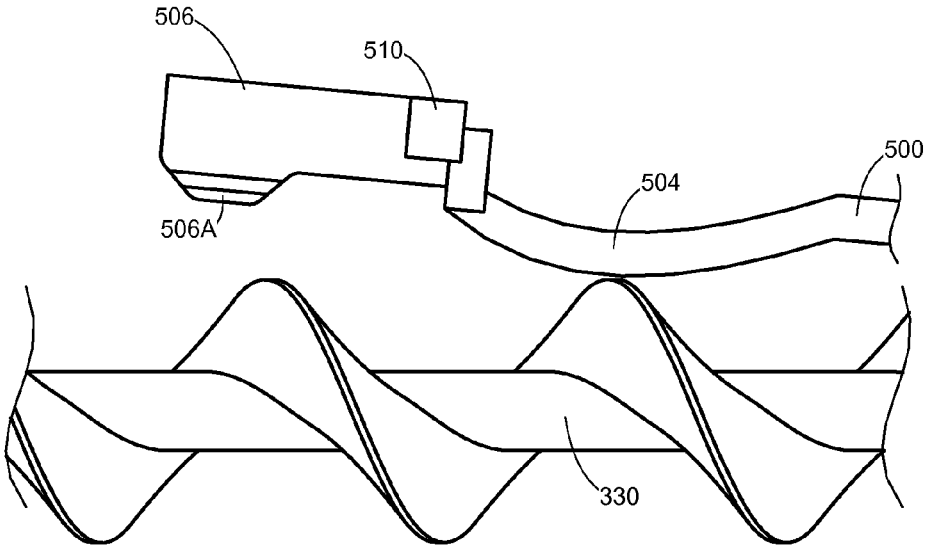

With reference to FIGS. 13A and 13B, like agitators 400 and 450, agitator 500 is actuated by the rotation of auger 330. Specifically, as auger 330 rotates, contact between arm segment 504 and auger 330 causes resiliently deflectable member 501 to deflect up and down. This oscillating motion causes protuberance 506A of distal segment 506 to move into and out of apertures 346 and 374 to break up compacted toner and push toner toward auger 330. With reference back to FIG. 11, a locating post 510 extends substantially perpendicularly from distal segment 506 to locate and limit the movement of distal segment 506 toward and away from apertures 346 and 374. Locating post 510 extends over arcuate wall 348 of enclosed portion 344 of channel 340. Arcuate wall 348 defines a hard stop position of locating post 510 thereby limiting further movement of distal segment 506 toward aperture 346. With reference back to FIG. 12, shutter 370 includes a cam surface 376 that engages distal segment 506 when shutter 370 moves from the open position to the closed position in order to clear protuberance 506A from aperture 374 to allow shutter 370 to close.

Figure 14:
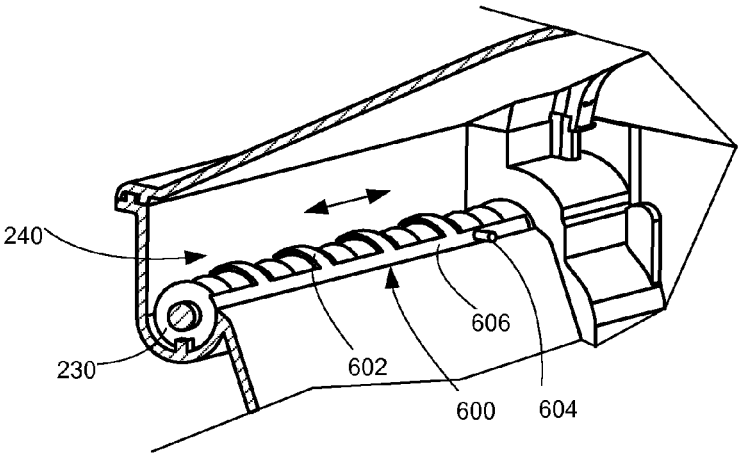
FIG. 14 is a perspective view showing an alternative embodiment of a side-to-side sliding agitator.
Figure 15A:
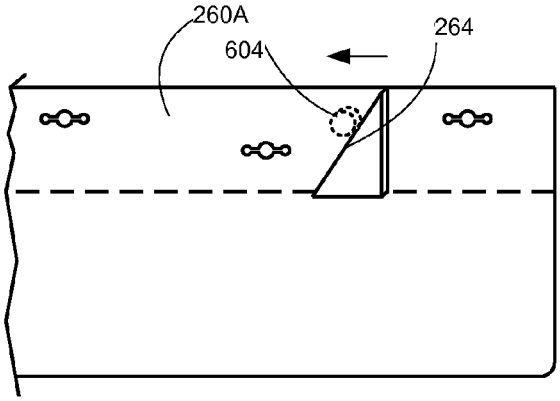
FIGS. 15A and 15B are cutaway illustrations of a first side and a second side of a paddle, respectively, having a cam surface for engaging a pin of the side-to-side sliding agitator of FIG. 14.
Figure 15B:
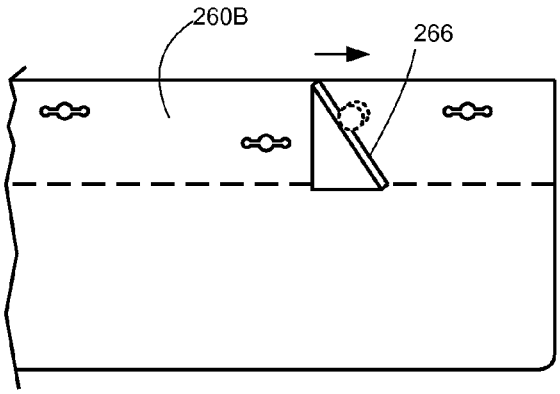

FIG. 14 shows a side-to-side sliding agitator 600 according to another example embodiment. Sliding agitator 600 includes a base 606 that spans along the length of channel 240 and/or 340 in front of or behind auger 230 and/or 330. A plurality of fingers 602 extend from base 606 above auger 230 and/or 330. In the example embodiment illustrated, fingers 602 have a substantially curved profile that wraps partly around the top of auger 230. A pin 604 extends from base 606 into the path of a rotating member such as paddle 260 of toner cartridge 200. As shown in FIGS. 15A and 15B, in this embodiment, paddle 260 includes a pair of alternating cam surfaces 264, 266, one on each radial end of paddle 260. Specifically, FIG. 15A shows a first cam surface 264 on the first radial end 260A of paddle 260. FIG. 15B shows a second cam surface 266 on the second radial end 260B of paddle 260. First cam surface 264 and second cam surface 266 are inclined in opposite directions such that first cam surface 264 and second cam surface 266 engage pin 604 on opposite sides during the rotation of paddle 260. As paddle 260 rotates, first cam surface 264 pushes pin 604 laterally to one side and second cam surface 266 pushes pin 604 laterally to the opposite side. This causes agitator 600 to oscillate back and forth from side to side to help break up compacted toner and to cause the toner to fall toward auger 230.

Figure 16:
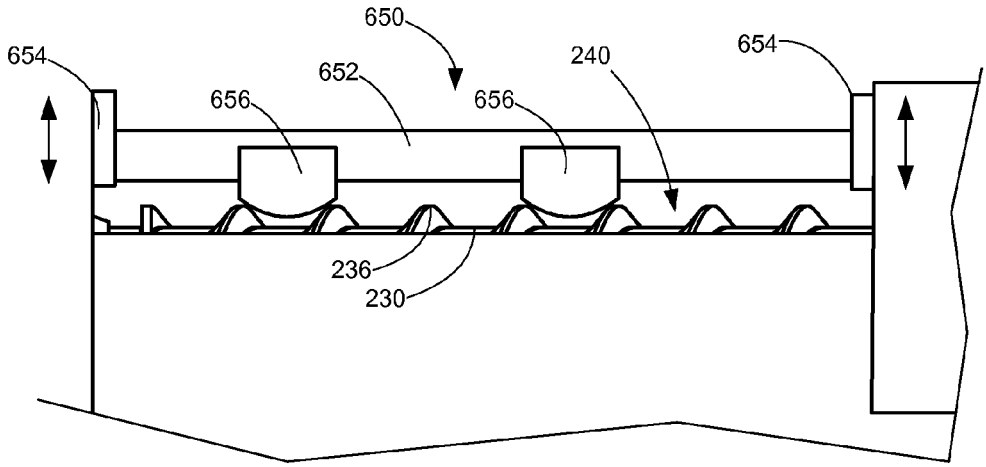
FIG. 16 shows an alternative embodiment of an up and down sliding agitator.

FIG. 16 shows an up and down sliding agitator 650 according to one example embodiment. Agitator 650 includes an elongated body 652 that spans the length of channel 240 or 340 and has distal ends that are supported in respective vertical slots 654 on each side wall of toner cartridge 200 or developer unit 301. Vertical slots 654 limit the movement of agitator 650 to substantially up and down only. A plurality of curved runners 656 extend downward from body 652 and ride on the flight 236 or 336 of auger 230 or 330. As auger 230 or 330 rotates, runners 656 ride up and down the flight 236 or 336 lifting and lowering agitator 650. This up and down motion agitates toner positioned above auger 230 or 330 causing it to fall toward auger 230 or 330 into channel 240 or 340. It will be appreciated that runners 656 may have different shapes as desired so long as their engagement with flight 236 or 336 causes agitator 650 to oscillate up and down.

Figure 17A:
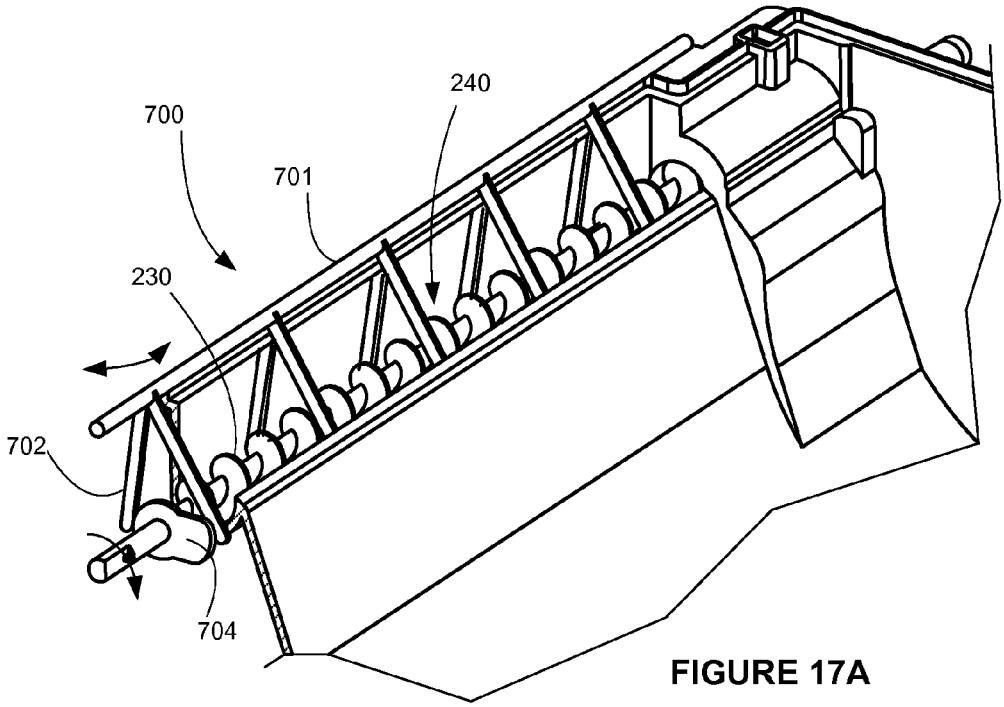
FIGS. 17A-C show an alternative embodiment of an oscillating agitator.
Figure 17B:
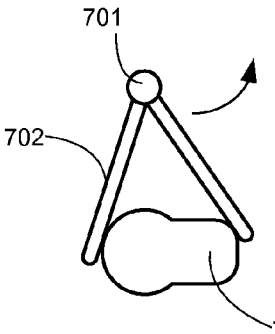
Figure 17C:
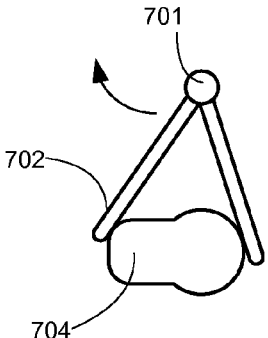

FIGS. 17A-C show another example agitator 700. In this embodiment, agitator 700 includes a rotatable member 701 that spans along the length of channel 240 or 340. A plurality of spaced apart, substantially inverted V-shaped arms 702 extend radially from rotatable member 701. A cam 704 is positioned near an end of auger 230 or 330 that engages arms 702 as auger 230 or 330 rotates. Specifically, as auger 230 or 330 rotates, cam 704 pushes arms 702 in an alternating manner causing agitator 700 to rotate about the longitudinal axis of rotatable member 701. This causes arms 702 to rock from one side to the other in the area surrounding auger 230 as illustrated in FIGS. 17B and 17C to break up compacted toner. It will be appreciated that arms 702 may take on other shapes as desired.

Figure 18:
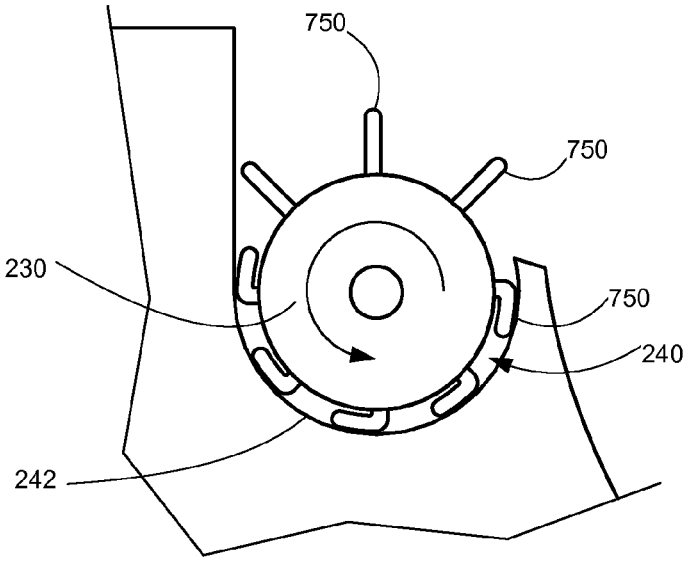
FIG. 18 is a side view of an alternative embodiment of an agitator according to another example embodiment.

FIG. 18 shows an additional example embodiment of an agitator. In this embodiment, auger 230 or 330 is provided with a plurality of fingers 750 extending radially therefrom. Fingers 750 are formed of a flexible and resilient material. As auger 230 or 330 rotates in the direction indicated in FIG. 18, fingers 750 positioned adjacent to the open area above channel 240 or 340 extend from the top of auger 230 or 330 upwardly and outwardly to break up any compacted toner above auger 230 or 330. As auger 230 or 330 rotates further, fingers 750 bend as they ride into trough 242 or 342.

Figure 19:
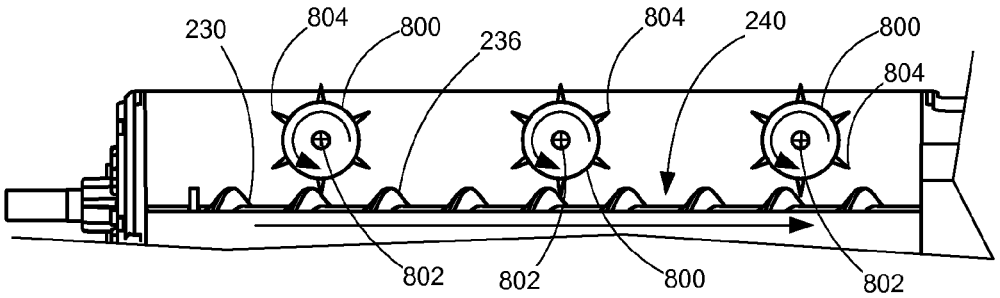
FIG. 19 shows an alternative embodiment of a plurality of rotatable agitators.

FIG. 19 shows another example embodiment in the form of rotating agitators 800. Each agitator 800 rotates about an axis of rotation 802 and includes one or more projections or teeth 804 that extend outwardly from agitator 800. Agitators 800 are driven by auger 230 or 330 such that as auger 230 or 330 rotates (in the direction indicated by the arrow below auger 230 in FIG. 19), teeth 804 are displaced by flight 236 or 336 causing agitators 800 to rotate about their respective axes 802 (as indicated in FIG. 19). This rotation causes teeth 804 to break up toner positioned above channel 240 or 340 causing the toner to fall toward auger 230 or 330.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

What is claimed is:

1. A removable unit for an electrophotographic image forming device, comprising:

a housing having an inner volume forming a toner reservoir and a channel for accumulating toner;

an auger for advancing toner within the channel, the auger having a rotational axis and a flight; and an agitator having a base mounted on an inner surface of the housing, the agitator extending in a cantilevered manner toward the auger, the agitator having a first segment and a second distal segment connected to the first segment, the second distal segment forming a free end of the agitator, the first segment having a proximal end connected to the base and a distal end connected to the second distal segment, the cantilevered extension of the agitator being along an axial length of the auger such that an axial position of the proximal end of the first segment is spaced from an axial position of the distal end of the first segment, wherein when the auger rotates, the flight of the auger engages the agitator causing movement of the second distal segment to push toner accumulated in the channel into the auger, wherein the first segment of the agitator is resiliently deflectable, the first segment of the agitator extends from the proximal end toward the rotational axis of the auger into contact with the auger and from the contact with the auger away from the rotational axis of the auger toward the distal end, and the flight of the auger engages the first segment of the agitator to cause movement of the second distal segment to move toner toward the auger.

2. The removable unit of claim 1, wherein the flight of the auger engages the first segment of the agitator at a location that is laterally offset from the rotational axis of the auger.

3. The removable unit of claim 1, wherein the first segment of the agitator spans a pitch of the flight of the auger.

4. The removable unit of claim 1, wherein the second distal segment of the agitator has a substantially planar undersurface that is transverse to the rotational axis of the auger.

5. The removable unit of claim 1, wherein the base includes a third segment mounted on the inner surface of the housing, the first segment and the second distal segment being resiliently deflectable relative to the third segment.

6. The removable unit of claim 1, further comprising a shutter moveable between an open position for allowing toner to enter the toner reservoir and a closed position for preventing toner from entering the toner reservoir, the shutter positioned to enclose at least an end of the auger and having an aperture on a circumferential wall of the shutter, at least a portion of the second distal segment extending into the aperture when the auger rotates, the shutter including a cam surface extending from the circumferential wall of the shutter positioned to engage the second distal segment to move the second distal segment away from the aperture when the shutter moves from the open position to the closed position.

7. The removable unit of claim 1, wherein the agitator includes a plurality of agitators spaced apart along the rotational axis of the auger, the plurality of agitators arranged such that when a first agitator of the plurality of agitators engages a crest of the auger, agitators immediately adjacent the first agitator do not engage a crest of the auger.

8. The removable unit of claim 7, wherein each of the plurality of agitators extends from the base and the agitators and base are integrally formed as a unitary member.

9. A toner conveyance assembly for an electrophotographic image forming device, comprising:

a channel for accumulating toner;

an auger for advancing toner within the channel, the auger having a rotational axis and a flight; and an agitator extending in a cantilevered manner towards the auger, the agitator having a first segment and a second distal segment connected to the first segment, the first segment having a proximal end and a distal end that is connected to the second distal segment, the second distal segment forming a free end of the agitator, wherein when the auger rotates, the flight of the auger engages the agitator causing movement of the second distal segment to push toner accumulated in the channel into the auger, wherein the first segment of the agitator is resiliently deflectable, the first segment of the agitator extends from the proximal end toward the rotational axis of the auger into contact with the auger and from the contact with the auger away from the rotational axis of the auger toward the distal end, and the flight of the auger engages the first segment of the agitator to cause movement of the second distal segment to move toner toward the auger.

10. The toner conveyance assembly of claim 9, wherein the flight of the auger engages the first segment of the agitator at a location that is laterally offset from the rotational axis of the auger.

11. The toner conveyance assembly of claim 9, wherein the first segment of the agitator spans a pitch of the flight of the auger.

12. The toner conveyance assembly of claim 9, wherein the second distal segment of the agitator has a substantially planar undersurface that is transverse to the rotational axis of the auger.

13. The toner conveyance assembly of claim 9, wherein the second distal segment of the agitator includes a locating post substantially perpendicular to the rotational axis of the auger, the locating post engaging a wall of the channel for controlling the movement of the second distal segment.

14. The toner conveyance assembly of claim 9, wherein the second distal segment of the agitator includes a protuberance extending toward the auger from a distal end of the second distal segment.

15. The toner conveyance assembly of claim 9, wherein the agitator includes a plurality of agitators spaced apart along the rotational axis of the auger, the plurality of agitators arranged such that when a first agitator of the plurality of agitators engages a crest of the auger, agitators immediately adjacent the first agitator do not engage a crest of the auger.

16. An agitator for a toner delivery device, comprising:

a base for mounting on an inner surface of a housing of the toner delivery device;

a resiliently deflectable first segment extending in a cantilevered manner from a proximal end of the first segment connected to the base to a distal end of the first segment; and a second distal segment connected to the distal end of the first segment and forming a free end of the agitator, wherein the first segment has a curved shape that bends from the proximal end down toward a position intermediate the proximal and distal ends and up away from the intermediate position toward the distal end.

17. A removable unit for an electrophotographic image forming device, comprising:

a housing having an inner volume forming a toner reservoir and a channel for accumulating toner;

an auger for advancing toner within the channel, the auger having a rotational axis and a flight; and an agitator mounted on an inner surface of the housing and positioned to extend toward the auger, the agitator having a first segment and a second distal segment connected to the first segment, wherein when the auger rotates, the flight of the auger engages the agitator causing movement of the second distal segment to push toner accumulated in the channel into the auger, further comprising a shutter moveable between an open position for allowing toner to enter the toner reservoir and a closed position for preventing toner from entering the toner reservoir, the shutter positioned to enclose at least an end of the auger and having an aperture on a circumferential wall of the shutter, at least a portion of the second distal segment extending into the aperture when the auger rotates, the shutter including a cam surface extending from the circumferential wall of the shutter positioned to engage the second distal segment to move the second distal segment away from the aperture when the shutter moves from the open position to the closed position.

* * * * *